US010755565B2

(12) United States Patent
Zhang et al.

(10) Patent No.: US 10,755,565 B2
(45) Date of Patent: Aug. 25, 2020

(54) PRIORITIZED VEHICLE MESSAGING

(71) Applicant: Ford Global Technologies, LLC, Dearborn, MI (US)

(72) Inventors: Linjun Zhang, Canton, MI (US); Helen Elizabeth Kourous-Harrigan, Monroe, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/252,206

(22) Filed: Jan. 18, 2019

(65) Prior Publication Data

US 2020/0234578 A1 Jul. 23, 2020

(51) Int. Cl.

| | |
|---|---|
| ***G08G 1/015*** | (2006.01) |
| ***G08G 1/052*** | (2006.01) |
| ***G08G 1/09*** | (2006.01) |
| ***G08G 1/01*** | (2006.01) |
| ***G08G 1/056*** | (2006.01) |

(52) U.S. Cl.

CPC ..... *G08G 1/093* (2013.01); *G08G 1/015* (2013.01); *G08G 1/0116* (2013.01); *G08G 1/0141* (2013.01); *G08G 1/052* (2013.01); *G08G 1/056* (2013.01)

(58) Field of Classification Search

None

See application file for complete search history.

(56) References Cited

U.S. PATENT DOCUMENTS

| | | | | |
|---|---|---|---|---|
| 9,671,791 | B1 * | 6/2017 | Paczan | B64C 39/024 |
| 2007/0035416 | A1 * | 2/2007 | Tanaka | B60T 7/18 340/906 |
| 2012/0072104 | A1 * | 3/2012 | Sakai | B60W 30/09 701/400 |
| 2012/0083998 | A1 * | 4/2012 | Kizaki | G08G 1/093 701/300 |
| 2017/0036674 | A1 * | 2/2017 | Izuhara | G08G 1/16 |
| 2017/0092126 | A1 * | 3/2017 | Oshida | G08G 1/096791 |
| 2017/0301233 | A1 | 10/2017 | Witt et al. | |

(Continued)

FOREIGN PATENT DOCUMENTS

| | | |
|---|---|---|
| CN | 104575039 A | 4/2015 |
| CN | 106781551 A | 5/2017 |

(Continued)

OTHER PUBLICATIONS

Vehicle Transponder for Preemption of Traffic Lights, Foster and Bachelder of Caltech for NASA's Jet Propulsion Laboratory, Sep. 2006.*

(Continued)

*Primary Examiner* — John F Mortell

(74) *Attorney, Agent, or Firm* — Frank A. MacKenzie; Bejin Bieneman PLC

(57) ABSTRACT

A computer includes a processor, and a memory storing instructions such that the processor. The processor is programmed to detect a plurality of objects proximate to an infrastructure node. The processor is further programmed to determine respective priorities for each of the objects based on respective characteristics of the objects; and include the objects in a wireless message to a vehicle based on the priorities.

20 Claims, 4 Drawing Sheets

(56) References Cited

U.S. PATENT DOCUMENTS

| | | | | |
|---|---|---|---|---|
| 2018/0129215 | A1 | 5/2018 | Hazelton et al. | |
| 2019/0035267 | A1* | 1/2019 | Balzer | G08G 1/017 |

FOREIGN PATENT DOCUMENTS

| | | | |
|---|---|---|---|
| JP | 2012011940 | A | 1/2012 |
| KR | 100825761 | B1 | 4/2008 |

OTHER PUBLICATIONS

Vehicle Transponder for Preemption of Traffic Lights by Foster and Bachelder, NASA Tech Briefs, Sep. 2006.*
Kapsch TrafficCom, "Connected Vehicles—V2X Technology" (8 pages).

* cited by examiner

PRIORITIZED VEHICLE MESSAGING

BACKGROUND

Roadside and/or traffic infrastructure can detect objects within a detection range of an infrastructure element including one or more sensors. An infrastructure element may provide data to computers, e.g., in vehicles via wireless communications. It is a problem that such data, e.g., from image sensors such as lidars or cameras, may consume significant and often impractical amounts of bandwidth.

DETAILED DESCRIPTION

Introduction

Figure 1:
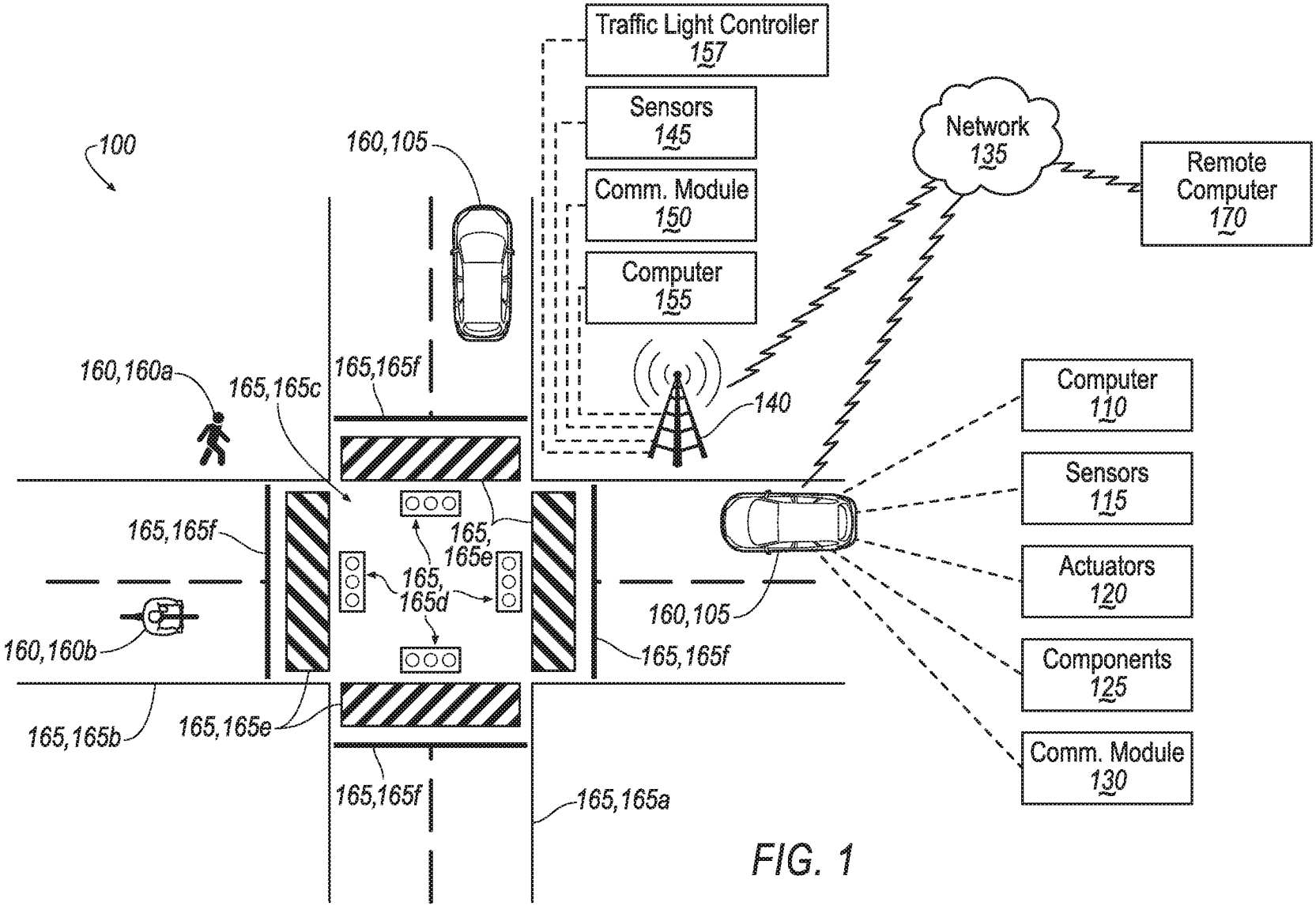
FIG. 1 is a diagram illustrating an example infrastructure system.

Disclosed is a computer comprising a processor and a memory, the memory storing instructions such that the processor is programmed to: detect a plurality of objects proximate to an infrastructure node; determine respective priorities for each of the objects based on respective characteristics of the objects; and include the objects in a wireless message to a vehicle based on the priorities.

The characteristics can include a type of object. The type of object can be one of a group including an on-duty vehicle, a not on-duty vehicle, a bicycle, a scooter and a pedestrian.

The characteristics can include a speed of the object.

The system can further comprise an intersection. The characteristics include one of entering or exiting the intersection.

The characteristics can include a likelihood that an object will violate a traffic regulation.

The characteristics include a time to reaching a stop line at an intersection.

The computer can be further programmed to: receive a status of a component of the object; and calculate the priority of the object based on the status of the component.

The object can be a vehicle, and the component can be one selected from a group of an emergency brake system, an anti-lock brake system and an electronic stability control system.

The computer can be further programmed to: receive a status of a traffic light at an intersection, wherein calculating the priority to include the objects in the wireless message is further based on the status of the traffic light.

Further disclosed is a method comprising detecting a plurality of objects proximate to an infrastructure node; determining respective priorities for each of the objects based on respective characteristics of the objects; and including the objects in a wireless message to a vehicle based on the priorities.

The characteristics can include a type of object. The type of object can be one of a group including an on-duty vehicle, a not on-duty vehicle, a bicycle, a scooter and a pedestrian.

The characteristics can include a speed of the object.

The characteristics can include one of entering or exiting an intersection.

The characteristics can include a likelihood that an object will violate a traffic regulation.

The characteristics can include a time to reaching a stop line at an intersection.

The method can further comprise: receiving a status of a component of the object; and calculating the priority of the object based on the status of the component.

The object can be a vehicle, and the component can be one selected from a group of an emergency brake system, an anti-lock brake system and an electronic stability control system.

The method can further comprise: receiving a status of a traffic light at an intersection, wherein calculating the priority to include the objects in the wireless message is further based on the status of the traffic light.

Further disclosed herein is a computing device programmed to execute any of the above method steps.

Further disclosed herein is a vehicle including a computing device programmed to execute any of the above method steps.

Yet further disclosed herein is a computer program product, including a computer readable medium storing instructions executable by a computer processor, to execute any of the above method steps.

Exemplary System Elements

A stationary support structure can support various components, such as sensors and a computer, mounted thereto (e.g., with various mounting mechanisms, housings, etc.). The computer can be programmed to receive data from one or more sensors mounted to the support structure and/or from one or more vehicles proximate to the support structure. Based on the received data, the computer can determine one or more physical attributes of the objects and/or vehicles proximate to the support structure and transmit/broadcast messages to one or more vehicles. By evaluating the one or more physical attributes such as a type, location, and trajectory of the objects (including the one or more vehicles), the infrastructure computer can prioritize the objects and/or vehicles included in the messages.

FIG. 1 is a block diagram of an example infrastructure communications and control system (or infrastructure system) 100. The system 100 includes one or more vehicles 105, each of which is a land vehicle such as a car, truck, motorcycle, etc. Each vehicle 105 can include a vehicle computer 110, sensors 115, actuators 120 to actuate various vehicle components 125, and a vehicle communications module 130. Via a network 135, the vehicle communications module 130 may allow the vehicle computer 110 to communicate with one or more data collection or infrastructure nodes 140 and a remote computer 170. Two vehicles 105 are shown in FIG. 1 for ease of illustration, but the system 100 can include one or more vehicles 105.

The vehicle computer 110 includes a processor and a memory such as are known. The memory includes one or more forms of computer-readable media, and stores instructions executable by the vehicle computer 110 for performing various operations, including as disclosed herein.

The vehicle computer 110 may operate a vehicle 105 in an autonomous, a semi-autonomous mode, or a non-autonomous (or manual) mode. For purposes of this disclosure, an autonomous mode is defined as one in which each of vehicle 105 propulsion, braking, and steering are controlled by the vehicle computer 110; in a semi-autonomous mode the vehicle computer 110 controls one or two of vehicles 105 propulsion, braking, and steering; in a non-autonomous mode a human operator controls each of vehicle 105 propulsion, braking, and steering.

The vehicle computer 110 may include programming to operate one or more of vehicle 105 brakes, propulsion (e.g., control of acceleration in the vehicle by controlling one or more of an internal combustion engine, electric motor, hybrid engine, etc.), steering, climate control, interior and/or exterior lights, etc., as well as to determine whether and when the vehicle computer 110, as opposed to a human operator, is to control such operations. Additionally, the vehicle computer 110 may be programmed to determine whether and when a human operator is to control such operations.

The vehicle computer 110 may include or be communicatively coupled to, e.g., via a vehicle 105 communications bus as described further below, more than one processor, e.g., included in electronic control units (ECUs) or the like included in the vehicle for monitoring and/or controlling various vehicle components 125, e.g., a powertrain controller, a brake controller, a steering controller, etc. The vehicle computer 110 is generally arranged for communications on a vehicle communication network that can include a bus in the vehicle such as a controller area network (CAN) or the like, and/or other wired and/or wireless mechanisms.

Via the vehicle 105 network, the vehicle computer 110 may transmit messages to various devices in the vehicle and/or receive messages from the various devices, e.g., sensors 115, an actuator 120, a human machine interface (HMI), etc. Alternatively or additionally, in cases where the vehicle computer 110 actually comprises a plurality of devices, the vehicle 105 communications network may be used for communications between devices represented as the vehicle computer 110 in this disclosure. Further, as mentioned below, various controllers and/or sensors 115 may provide data to the vehicle computer 110 via the vehicle communication network.

Vehicle 105 sensors 115 may include a variety of devices such as are known to provide data to the vehicle computer 110. For example, the sensors 115 may include Light Detection And Ranging (LIDAR) sensor(s) 115, etc., disposed on a top of the vehicle 105, behind a vehicle 105 front windshield, around the vehicle 105, etc., that provide relative locations, sizes, and shapes of objects surrounding the vehicle 105. As another example, one or more radar sensors 115 fixed to vehicle 105 bumpers may provide data to provide locations of the objects, second vehicles 105, etc., relative to the location of the vehicle 105. The sensors 115 may further alternatively or additionally, for example, include camera sensor(s) 115, e.g. front view, side view, etc., providing images from an area surrounding the vehicle 105.

The vehicle 105 actuators 120 are implemented via circuits, chips, or other electronic and or mechanical components that can actuate various vehicle subsystems in accordance with appropriate control signals as is known. The actuators 120 may be used to control vehicle components 125, including braking, acceleration, and steering of a vehicle 105.

In the context of the present disclosure, a vehicle component 125 is one or more hardware components adapted to perform a mechanical or electro-mechanical function or operation—such as moving the vehicle 105, slowing or stopping the vehicle 101, steering the vehicle 105, etc. Non-limiting examples of vehicle components 125 include a propulsion component (that includes, e.g., an internal combustion engine and/or an electric motor, etc.), a transmission component, a steering component (e.g., that may include one or more of a steering wheel, a steering rack, etc.), a brake component (as described below), a park assist component, an adaptive cruise control component, an adaptive steering component, a movable seat, etc.

In addition, the vehicle computer 110 may be configured for communicating via a vehicle-to-vehicle communications module 130 with devices outside of the vehicle 105, e.g., through a vehicle-to-vehicle (V2V) or vehicle-to-infrastructure (V2X) wireless communications to another vehicle, to an infrastructure node 140 (typically via direct radio frequency communications) and/or (typically via the network 135) a remote computer 170. The vehicle communications module 130 could include one or more mechanisms by which the computers 110 of vehicles 105 may communicate, including any desired combination of wireless (e.g., cellular, wireless, satellite, microwave and radio frequency) communication mechanisms and any desired network topology (or topologies when a plurality of communication mechanisms are utilized). Exemplary communications provided via the vehicle communications module 130 include cellular, Bluetooth, IEEE 802.11, dedicated short range communications (DSRC), cellular V2V, and/or wide area networks (WAN), including the Internet, providing data communication services.

The network 135 represents one or more mechanisms by which a vehicle computer 110 may communicate with an infrastructure node 140 and/or remote computer 170. Accordingly, the network 135 can be one or more of various wired or wireless communication mechanisms, including any desired combination of wired (e.g., cable and fiber) and/or wireless (e.g., cellular, wireless, satellite, microwave, and radio frequency) communication mechanisms and any desired network topology (or topologies when multiple communication mechanisms are utilized). Exemplary communication networks include wireless communication networks (e.g., using Bluetooth®, Bluetooth® Low Energy (BLE), IEEE 802.11, vehicle-to-vehicle (V2V) such as Dedicated Short Range Communications (DSRC), etc.), local area networks (LAN) and/or wide area networks (WAN), including the Internet, providing data communication services.

Vehicle-to-vehicle and vehicle-to-infrastructure communications are typically organized in packets, with each packet having a maximum payload. For example, a packet of data transmitted via Dedicated Short Range Communications (DSRC) is limited to 1200 bytes. In the case that the data to be transmitted exceeds the size of the maximum payload for a packet, the transmitting/broadcasting device, for example the infrastructure node 140, may provide the message in a plurality of packets typically provided in sequence, i.e., each of the packets in the plurality providing a respective portion of the message. Data included in packets later in a sequence of packets will have increased latency relative to data included in packets provided earlier in the sequence. In the case of data indicating a potential collision of a vehicle 105 with some other object, an increased latency of one or more packets later in, e.g., at the end of, the sequence may prevent timely and/or safe decision making by a vehicle 105 receiving the data. Programming the infrastructure node 140 to assign priorities to data such that data having a higher potential impact on safety has a higher priority than data having a lower potential impact on safety and broadcasting the data with a highest priority data being transmitted first, may enable safer decision making and path planning by vehicles 105 and optimize the use of available bandwidth.

An infrastructure node 140 includes a physical structure such as a tower or other support structure (e.g., a pole, a box mountable to a bridge support, cell phone tower, road sign support, etc.) on which infrastructure node sensors 145, as well as an infrastructure communications module 150 and infrastructure computer 155 can be mounted, stored, and/or contained, and powered, etc. One infrastructure node 140 is shown in FIG. 1 for ease of illustration, but the system 100 could include one or more infrastructure nodes 140. In a case of the system 100 having multiple infrastructure nodes 140, one of the infrastructure nodes 140 may assume responsibility for communicating with vehicles 105 within a region of interest. The region of interest may be an area within a detection range of the infrastructure node sensors 145. For example, as described in additional detail below, the region of interest may be an area surrounding and including an intersection 165*c* that can be monitored by the infrastructure node 140.

The infrastructure node 140 is typically stationary, i.e., fixed to and not able to move from a specific geographic location, and may be referred to herein as a stationary support structure. The infrastructure node sensors 145 may include one or more sensors such as described above for the vehicle 105 sensors 115, e.g., lidar, radar, cameras, ultrasonic sensors, etc. The infrastructure node sensors 145 are fixed or stationary. That is, each sensor 145 is mounted to the infrastructure node so as to have a substantially unmoving and unchanging field of view. Alternatively or additionally, a sensor 145 could be mounted to rotate or otherwise move a field of view, e.g., on a movable arm, rotatable platform, or the like.

Sensors 145 thus provide fields of view in contrast to vehicle 105 sensors 115 in a number of advantageous respects. First, because sensors 145 can have a substantially constant field of view, determinations of vehicle 105, mobile object 160, and infrastructure object 165 locations can be accomplished with fewer and simpler processing resources than if movement of the sensors 145 also had to be accounted for. Further, the sensors 145 include an external perspective of the vehicle 105 and can sometimes detect features and characteristics of mobile objects 160 and infrastructure objects 165 not in the vehicle 105 sensors 115 field(s) of view and/or can provide more accurate detection, e.g., with respect to vehicle 105 location and/or movement with respect to other mobile objects 160 and infrastructure objects 165. Yet further, sensors 145 can communicate with the infrastructure computer 155 via a wired connection, whereas vehicles 105 typically can communicates with infrastructure nodes 140 and/or a remote computer 170 only wirelessly, or only at very limited times when a wired connection is available. Wired communications are more reliable and can be faster than wireless communications such as vehicle-to-infrastructure communications or the like.

The infrastructure communications module 150 and infrastructure computer 155 typically have features in common with the vehicle computer 110 and vehicle communications module 130, and therefore will not be described further to avoid redundancy. Although not shown for ease of illustration, the infrastructure node 140 also includes a power source such as a battery, solar power cells, and/or a connection to a power grid.

The infrastructure node 140 may further include a traffic light controller 157. The traffic light controller 157 may be a computer having features in common with, for example, the vehicle computer 110. The traffic light controller 157 may be programmed to control traffic lights 165*d* denoting directions of allowed and prohibited travel through the intersection 165*c*. The traffic light control 157 may be further programmed to provide a status of traffic lights 165*d*, e.g., green, yellow, red, to the infrastructure computer 155.

An infrastructure node 140 can be provided to monitor one or more mobile objects 160 within a region of interest. An "object", in the context of this disclosure, is a physical, i.e., material, structure detected by a sensor 115 and/or 145. A "mobile" object 160 is an object that is capable of moving, even though the mobile object 160 may or not be actually moving at any given time. The "mobile" object 160 is so designated for convenience to distinguish from fixed or infrastructure objects 165, discussed further below. Example mobile objects include a pedestrian mobile object 160*a*, a bicycle (including a rider) 160*b*, etc. As should be readily apparent, the one or more vehicles 105 in the system 100 can qualify as mobile objects 160, hence the term mobile object(s) 160, as used herein, also refers to vehicles 105. Additional types or subtypes of mobile objects 160 may include, without limitation: motorcycles, which may be considered a type of mobile object 160 separate from vehicles 105; small children, which may be considered a type of mobile object 160 separate from pedestrian mobile objects 160*a*; scooters; and animals such as pets, geese, etc. proximate to the infrastructure 140 may be mobile objects 160 and as such assigned a priority.

The infrastructure node 140 can monitor physical features of mobile objects 160, i.e., the infrastructure computer 155 can receive and analyze data from sensors 145 substantially continuously, periodically, and/or when instructed by a remote computer 170, etc. A physical feature in this context is a physical attribute or characteristic of the mobile object 160, such as a shape, size, speed, direction, acceleration, etc. Further, conventional object classification or identification techniques can be used, e.g., in the infrastructure computer 155 based on LIDAR sensor 145, camera sensor 145, etc., data, to identify a type of object. A type of object is defined herein as a classification or category of objects having common features. Non-limiting examples of a type of object 160 include vehicles, people, bicycles, etc.

In addition to data from infrastructure node sensors 145, and vehicle sensors 115, the infrastructure computer 155 can receive vehicle status data from the vehicles 105. The vehicle status data can include data such as direction, speed, acceleration, etc. of the vehicle 105. The vehicle status data can further include data indicating a status of vehicle components 125. For example, the vehicle status data may include data indicating an emergency brake status, an anti-lock braking system (ABS) status, an electronic stability control (ESC) system status, etc. for the respective vehicle 105.

An infrastructure object 165, as mentioned above, is an object that, typically by design, is fixed and/or remains stationary with respect to the infrastructure node 140. For example, infrastructure objects 165 can include roads 165*a*, 165*b*, an intersection 165*c*, traffic lights 165*d*, crosswalks 165*e*, stop lines 165*f*, etc. Infrastructure objects 165 often are provided to govern or guide pedestrian and/or vehicular traffic, e.g., a traffic light regulates the passage of mobile objects such as pedestrians 106*a*, bicycles 106*b*, vehicles 105, etc. at various locations, e.g., at the intersection 165*c*. Stop lines 165*f* can designate a location where a mobile object such as a vehicle 105 or bicycle 160*b* is expected to stop at the intersection 165*c* for stop signs or when the traffic light 165*d* is red for the direction of travel of the mobile object 160. Crosswalks 165*e* designate areas where pedestrians can cross a road 165*a*, 165*b* based on traffic regulations and on the status of traffic lights 165*d*.

The remote computer 170 can be a conventional computing device, i.e., including one or more processors and one or more memories, programmed to provide operations such as disclosed herein. Further, the remote computer 170 can be accessed via the network 135, e.g., the Internet or some other wide area network.

Figure 2:
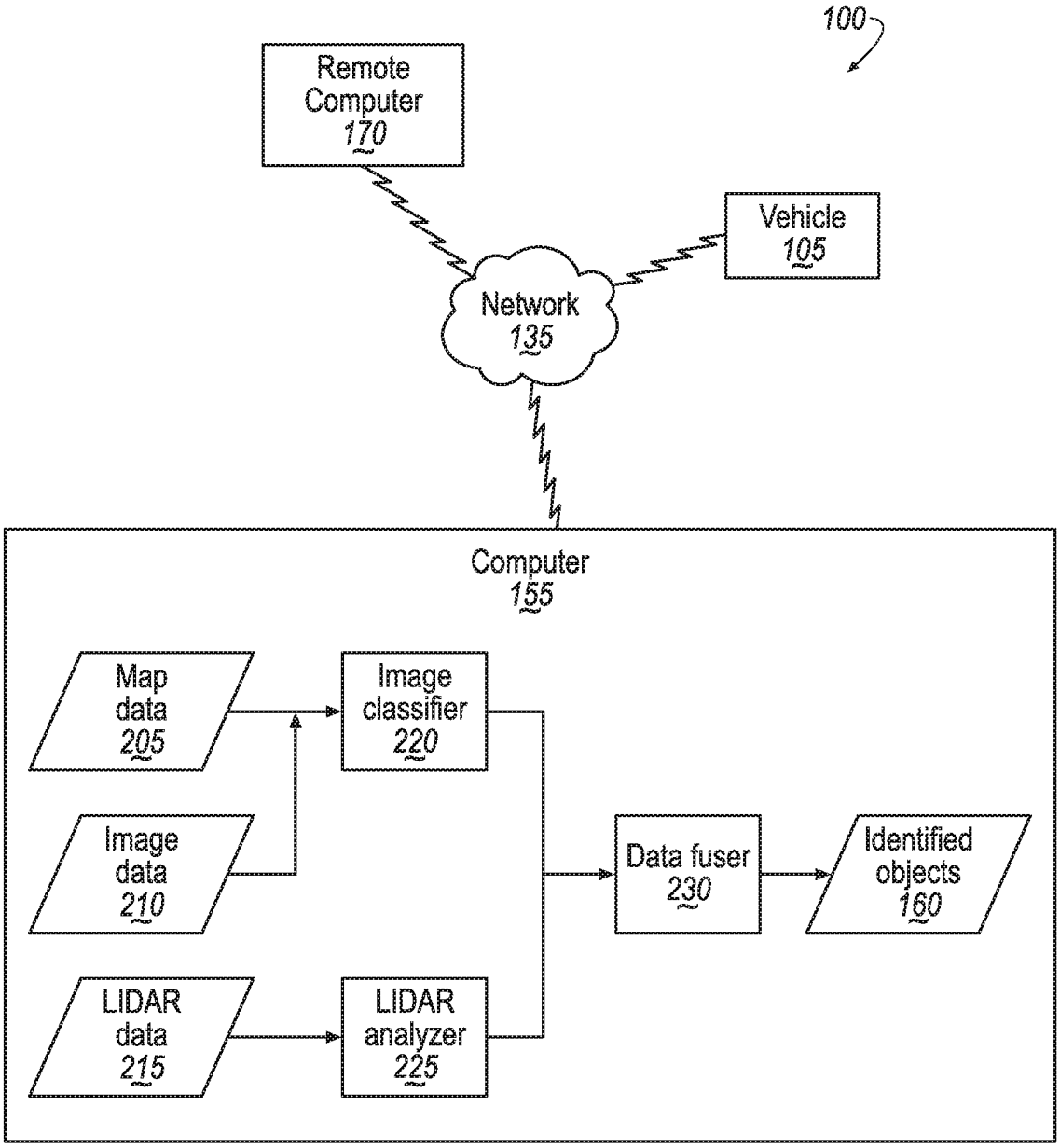
FIG. 2 is a block diagram illustrating processing in an infrastructure node computer.

FIG. 2 is a block diagram illustrating processing in an infrastructure computer 155.

An infrastructure computer 155 can include a memory or other storage with map data 205 describing an area (e.g., within a predetermined radius such as 100 meters, 200 meters, etc.) around the intersection 165*c*. The region of interest may be equal to, or a subset of the area described by the map data 205. As an example, the map data 205 could be received and/or periodically updated from the remote computer 170, by a technician servicing the infrastructure node 140, etc. Map data 205 typically includes geo-coordinates defining fixed or stationary objects 165, e.g., the roads 165*a*, 165*b*, the intersection 165*c*, the stoplights 165*d*, the crosswalks 165*e*, the stop lines 165*f*, etc.

Further, the infrastructure computer 155 can receive various data from the infrastructure node sensors 145 as well as, e.g., via V2X communications, from vehicle 105 sensors 115. Image data 210 is digital image data, e.g., comprising pixels with intensity and color values, can be acquired by camera sensors 115, 145. LIDAR data 215 typically includes conventional LIDAR point cloud data acquired by lidar sensors 115, 145, i.e., including data describing points in three dimensions, that is, each point representing a location of a surface of a mobile object 160 or infrastructure object 165.

Map data 205 and image data 210 can be provided to a classifier 220. The classifier 220 comprises programming to utilize one or more conventional image classification techniques. For example, the classifier can use a machine learning technique in which images 210 of various mobile objects 160 and physical features thereof, can be provided to a machine learning program for training the classifier 220. Training images 210 can be provided from a plurality of infrastructure nodes 140, from images gathered by vehicles 105, or other sources. Once trained, the classifier 220 can accept as input an image 210 and then provide as output, for each of one or more respective regions of interest in the image 210, an indication of one or more mobile objects 160 or an indication that no mobile object 160 is present in the respective region of interest.

Map data 205 is used to specify the region of interest in an image 210. For example, map data 205 may specify geo-coordinates or the like for various physical features of infrastructure objects 165 proximate to the intersection 165*c*. Proximate to the intersection 165*c* may be, for example, within a predetermined distance of the intersection 165*c*, or, as another example, within a defined (regular or irregular area) surrounding the intersection 165*c*. The predetermined distance may be, a fixed distance, for example 50 meters or 100 meters from the intersection 165*c*. Programming of the classifier 220 or otherwise included in the infrastructure computer 155 can determine the region of interest in an image 210 according to geo-coordinates specified in map data 205. That is, geo-coordinates in map data 205 can be mapped or associated to Cartesian or polar coordinates in an image sensor 145 field-of-view. The classifier 220 can identify coordinates in an image 210 representing the region of interest based on geo-coordinates in map data 205 e.g., a field of view of one or more sensors 145 or a subset thereof, e.g., a crosswalk 165*e* and an area of a road 165*a* including the crosswalk 165*e*, such as ten meters of road 165*a*, 165*b* in either direction of the crosswalk 165*e*. The region of interest can then be analyzed by the classifier 220 according to conventional image classification and/or object recognition techniques. Accordingly, the classifier 220 can output identification of one or more mobile objects 160 with respective geo-coordinates, i.e., according to map data 205, of each identified mobile object 160.

Data fuser 230 comprises further programming in the infrastructure computer 155. The data fuser includes programming to accept as input a first set of one or more mobile objects 160 identified by the image classifier 220 and a second set of one or more mobile objects 160 identified by the lidar analyzer 225. The data fuser 230 can output a third set of one or more identified mobile objects 160. The set of identified mobile objects 160 could be provided in the form of a list, a table, or the like, where each mobile object 160 in the set is identified by an identifier and/or description, e.g., "pedestrian (or person)" "vehicle," "bicycle with rider," etc., along with a set of geo-coordinates identifying a location or locations of the respective mobile object 160. For example, the geo-coordinates could specify a center or reference point, e.g., for a mobile object 160.

Further, object features can be determined from sensor 145 data once a mobile object 160 is identified. For example, a mobile object 160 trajectory can be determined, e.g., using conventional techniques to track the mobile object 160 according to LIDAR sensor 145 data. Alternatively or additionally, as noted above, a mobile object 160 location can be determined, e.g., with reference to map data 205.

Identified mobile objects 160 can be determined by the following processing by the data fuser 230. Specifically, the data fuser 230 can compare each mobile object 160 identified in the first set to each mobile object 160 identified in the second set to determine if a combined confidence in a mobile object 160 identified by image data 210 and lidar data 215 warrants a conclusion that the mobile object 160 can be identified. For example, conventional image classification and lidar data analysis techniques may be used in the image classifier 220 and lidar analyzer 225, respectively, to assign a confidence level, e.g., a number between or including zero and one, to each predicted mobile object 160. When a combination of the confidences of mobile object 160 predictions from the image classifier 220 and the lidar analyzer 225 meets or exceeds a threshold, then the mobile object 160 may be included in the feature conditions 235 output from the data fuser 230. In one example, a mobile object 160 may be included in the conditions 235 if either the image classifier 220 or the lidar analyzer 225 predict the mobile object 160 with a confidence above a predetermined threshold, e.g., 0.9 or 90%.

Figure 3:
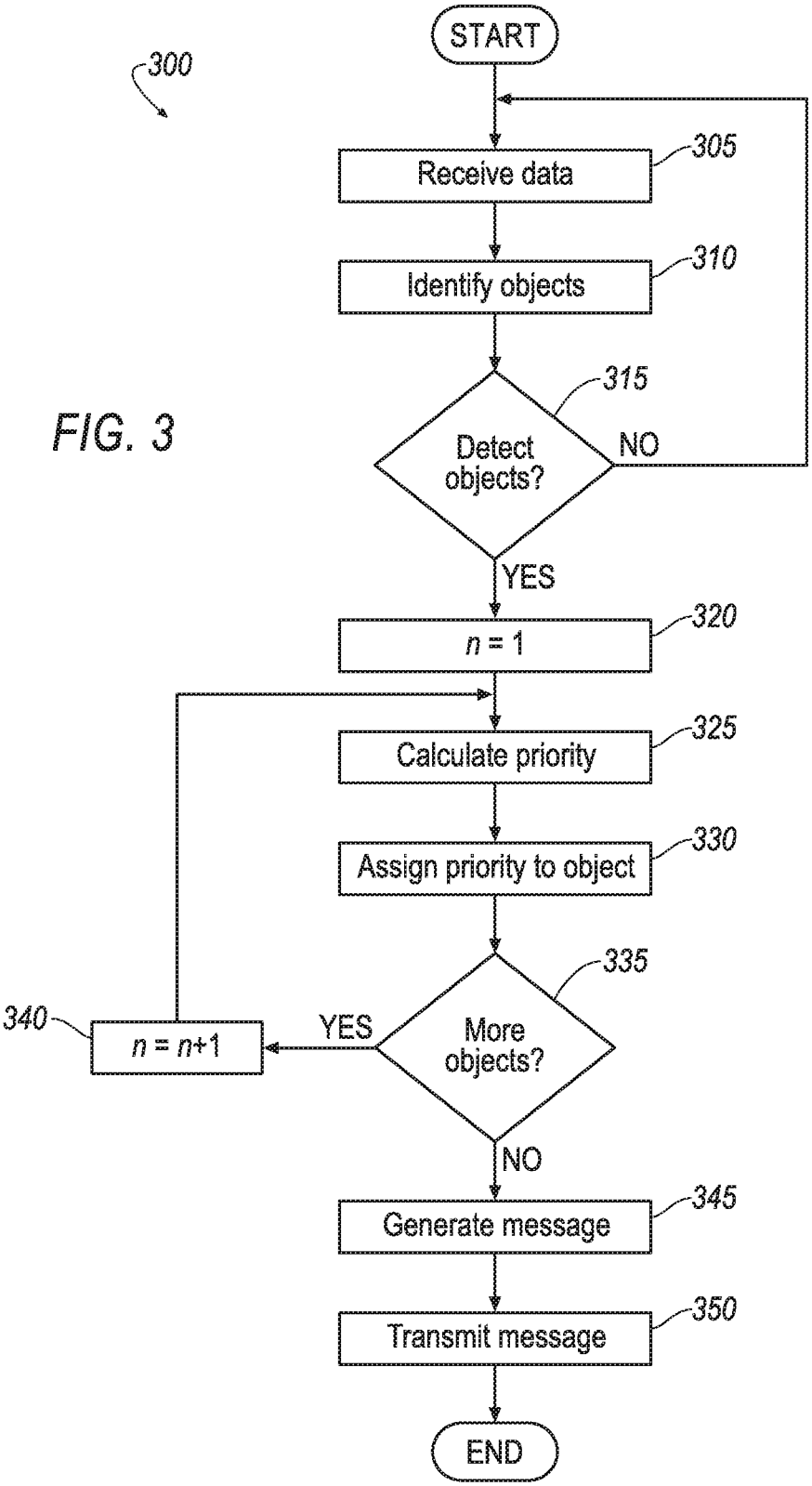
FIG. 3 is a flowchart of an exemplary process for prioritizing objects to be represented in a broadcast message.

FIG. 3 is a flowchart of an exemplary process 300 for processing infrastructure node sensor 145 data, vehicle 105 sensor 115 data and vehicle 105 status data to prioritize mobile objects 160 to be included in a wireless traffic message from the infrastructure node 140 to the one or more vehicles 105. The process 300, blocks of which can be executed in an order different than that described herein and/or can be executed in combination with other processing, and/or by omitting certain processing described herein, can be executed by programming in the infrastructure computer 155.

The process 300 begins in a block 305, in which the infrastructure computer 155 receives sensor 145 data, e.g., image data 210 and/or LIDAR data 215. Further, the infrastructure computer 155 could receive map data 205, e.g., from a remote computer 170, in the block 305, but also could receive the map data 205 outside of the process 300, e.g., by periodic download from the remote computer 170. Moreover, receipt of sensor 145 data in the infrastructure computer 155 could be performed substantially continuously, or alternatively could be performed on a periodic basis, e.g., every five minutes, every hour, etc. Yet further, a message from the remote computer 170 or some other device via the network 135 could trigger or instruct the infrastructure computer 155 to obtain sensor 145 data.

Yet further, the infrastructure computer 155 could receive data from the one or more vehicles 105. The data from the vehicles 105 may include image data from vehicle 105 sensors 115 related to mobile objects 160. The data from the vehicles 105 may further include status data for the respective data such as a direction, speed, acceleration of the respective vehicle 105, or operating status of a vehicle component such as respective emergency brakes, anti-lock braking system, electronic stability control system, etc. The process 300 continues in a block 310.

In the block 310, the infrastructure computer 155 utilizes the image classifier 220, lidar analyzer 225, and data fuser 230 to generate a set of identified mobile objects 160, as described above, and then determines whether any vehicles 105 are proximate to the infrastructure node 140, e.g., which means that the vehicle(s) 105 is/are within a field of sensor (s) 145 and have been detected and included in the identified mobile objects 160.

Typically, for each identified vehicle 105 in the block 310, the infrastructure computer 155 stores identifying indicia, i.e., data that can be used to identify the vehicle 105. In some instances, sensor data can provide an image of a vehicle 105 license plate or tag from which a license plate number or the like can be identified, e.g., using conventional image analysis techniques. However, alternatively or additionally, e.g., if a unique identifying indicia is not available, the infrastructure computer 155 can store an image of the vehicle 105 for later identification. For example, the image could be transmitted to the remote computer 170 for review and analysis. Yet further, the vehicle 105 could transmit, e.g., according to Dedicated Short Range Communications or some other wireless communications, an identifier to the infrastructure node 140.

Next, in a block 315, the infrastructure computer 155 determines whether a vehicle 105 has been detected as described above concerning the block 310. If not, the process 300 returns to the block 305 (or alternatively, although not shown in FIG. 3, the process 300 could end). Further, implementations are possible in which, even if a vehicle 105 is not detected, infrastructure node sensors 145 collect data concerning other mobile objects 160, which data may be stored for future use. In any event, if a vehicle 105 is detected, then the process 300 proceeds to a block 320.

In the block 320, the infrastructure computer 155 initializes an object index, e.g., sets an object index n equal to one. The infrastructure computer 155 utilizes the object index n to identify a mobile object 160 within the list of mobile objects 160. For example, index n=1 may designate a first mobile object 160 in the list of mobile objects 160. The process 300 continues in a block 325.

In the block 325, the infrastructure computer 155 calculates a priority for the $n^{th}$ mobile object 160. The infrastructure computer 155 may invoke the process 400, described below, to calculate an object priority $P_{object}$. The object priority $P_{object}$ is a quantitative rating, e.g., a numerical value, that the infrastructure computer 155 can use to prioritize mobile objects 160 to be included in a message to be broadcast by the infrastructure node 140. Upon calculating the object priority $P_{object}$ for the $n^{th}$ mobile object 160, the process 300 continues in a block 330.

In the block 330, the infrastructure computer 155 assigns a priority to the $n^{th}$ mobile object 160. For example, the infrastructure computer 155 may store the object priority $P_{object}$ as a characteristic of the $n^{th}$ mobile object 160 in the table of mobile objects 160 described above. The process 300 continues in a block 335.

In the block 335, the infrastructure computer 155 determines whether the list of mobile objects 160 includes additional mobile objects 160. That is, the computer determines whether n is less than m, where m is the number of mobile objects 160 in the list of mobile objects 160. In the case that n is less than m, the process 300 continues in a block 340. In the case that n=m, the process 300 continues in a block 345.

In the block 340, the infrastructure computer 155 is programmed to increment the mobile object index n. For example, the infrastructure computer 155 sets n=n+1. The process 300 continues in the block 325.

In the block 345, that may follow the block 335, the infrastructure computer 155 is programmed to generate a message. The infrastructure computer 155 includes data related to mobile objects 160 in the message in an order based on the calculated object priority $P_{object}$ for each of the respective mobile objects 160. In an example, the infrastructure computer 155 starts with the mobile object 160 with the highest priority and continues through the list of mobile objects 160 until either all the mobile objects 160 in the list of mobile objects 160 are included, or there is insufficient capacity in the message to include additional data. In another example, the infrastructure computer 155 may omit mobile objects 160 with a priority below a predetermined threshold from the message, even though sufficient bandwidth is available. The process 300 continues in a block 350.

In the block 350, the infrastructure computer 155 is programmed to broadcast the message to vehicles 105. For example, the message may be broadcast according to Dedicated Short Range Communications (DSRC). The process 300 ends.

Figure 4:
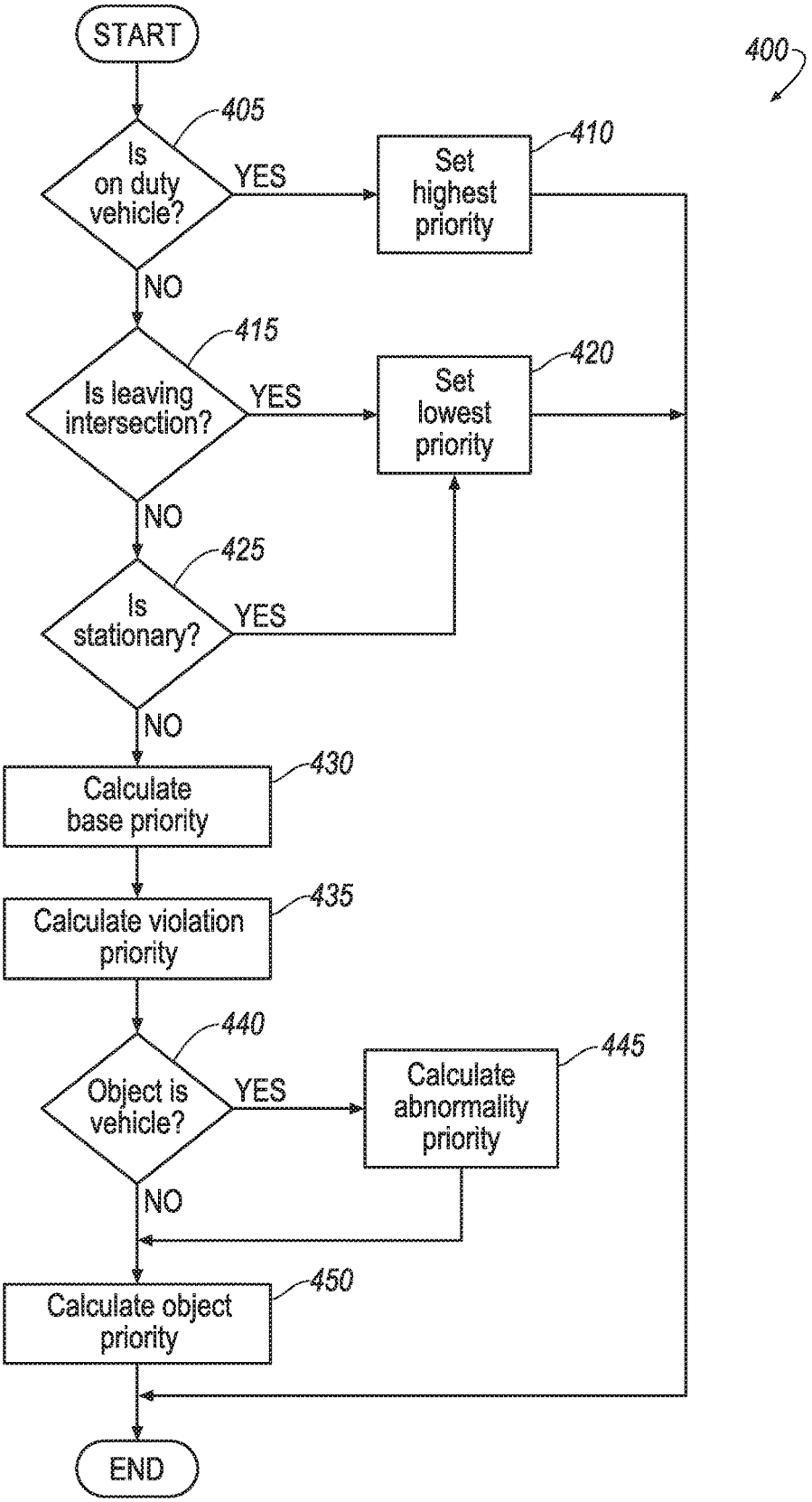
FIG. 4 is a flowchart of an exemplary process for calculating a priority for an object.

FIG. 4 is a flowchart of an exemplary process 400 for an infrastructure node 140 to calculate an object priority $P_{object}$ for a mobile object 160 in the region of interest. For example, the mobile object 160 may be assigned an object priority $P_{object}$ from 0 to 3.1, with 3.1 being the highest priority and 0 being the lowest priority. The infrastructure computer 155 is programmed to determine the object priority $P_{object}$ of the mobile object 160 based on characteristics of the mobile object 160. A characteristic of an object is defined herein as a measurement of some or all of an object 160 and serving to identify it and/or its operational status. A non-limiting list of characteristics used to determine the object priority $P_{object}$ include the type of the mobile object 160, a location of the mobile object 160 relative to the intersection 165*c*, a direction, speed, and acceleration of the mobile object 160, a time to arrive at or enter the intersection 165*c*, a conformance of the mobile object 160 to traffic regulations, and a status of vehicle components 125 such as an emergency brake system, anti-lock braking system (ABS) and/or electronic stability control (ESC) system on the mobile object 160.

The infrastructure computer 155 in the infrastructure node 140 may invoke the process 400 from the process 300 after collecting data related to mobile objects 160 included in the region of interest. The process 400 receives data related to an $n^{th}$ mobile object 160 included in the list of mobile objects 160 and determines a priority of the $n^{th}$ mobile object 160. The process 400 starts in a block 405.

In the block 405, the infrastructure computer 155 determines whether the $n^{th}$ mobile object 160 is an on-duty vehicle 105. An on-duty vehicle 105 is defined herein as a vehicle designated to be assigned a highest priority due to a high likelihood of being used for public safety or life-saving purposes such as police vehicle 105 or an ambulance 105. The term "on-duty' is used for convenience to distinguish "on-duty" vehicles 105 from "standard" or "not on-duty" vehicles 105, that are not designated for public safety or life-saving purposes. The infrastructure computer 155 may determine that the $n^{th}$ mobile object 160 is an on-duty vehicle 105 based on physical characteristics such as the detection of rotating lights, light arrays, and/or "police" or "ambulance" marking on the $n^{th}$ mobile object 160. Additionally or alternatively, the infrastructure computer 155 may receive status data from the $n^{th}$ mobile object 160 indicating that that $n^{th}$ mobile object 160 is an on-duty vehicle 105. In some cases, the mobile object 160 may be programmed to transmit data indicating that, although it is an on-duty vehicle 105, it is currently not being utilized for public safety or life-saving purposes and can be considered as a not on-duty vehicle 105.

In the case that the infrastructure computer 155 determines that the $n^{th}$ mobile object 160 is an on-duty vehicle 105, the process 400 continues in a block 410. Otherwise, the process 400 continues in a block 415.

In the block 410, the infrastructure computer 155 assigns a highest priority to the mobile object 160. For example, in the case that priorities are set in a range from 0 to 3.1, the infrastructure computer 155 may assign a priority to the mobile object 160 of 3.1. In this case, for example, a highest possible calculated object priority $P_{object}$ for a not on-duty vehicle 105 may be limited to 3.0, such that the object priority $P_{object}$ for not on-duty vehicles 105 remains below the object priority $P_{object}$ for on-duty vehicles 105. The process 400 ends. The infrastructure computer 155 may continue the process 300 at the block 330.

In the block 415, which may follow the block 405, the infrastructure computer 155 is programmed to determine whether the mobile object 160 is leaving the intersection 165*c*. For example, based on the sensor data and/status data, the infrastructure computer 155 may determine the location and direction of the $n^{th}$ mobile object 160. In the case that the $n^{th}$ mobile object 160 is leaving the intersection 165*c*, the process 400 continues in a block 420. Otherwise, the process continues in a block 425.

In the block 420, the infrastructure computer 155 assigns a lowest priority to the $n^{th}$ mobile object 160. For example, in the case that priorities are set in a range from 0 to 3.1, the infrastructure computer 155 may assign a priority to the $n^{th}$ mobile object 160 of 0. The process 400 ends. The infrastructure computer 155 may continue the process 300 at the block 330.

In the block 425, which may follow the block 415, the infrastructure computer 155 is programmed to determine whether the $n^{th}$ mobile object 160 is stationary. For example, the $n^{th}$ mobile object 160 may be a vehicle 105 stopped at the intersection 165*c*. In the case that the $n^{th}$ mobile object 160 is stationary, the process 400 continues in the block 420. In the case that the $n^{th}$ mobile object 160 is not stationary (i.e., is moving), the process 400 continues in a block 430.

In the block 430, the infrastructure computer 155 calculates a base priority $P_{base}$ for the $n^{th}$ mobile object 160. The base priority $P_{base}$ is a numerical value, calculated based on a type of the $n^{th}$ mobile object 160, and a time until the $n^{th}$ mobile object 160 will reach a stopping point. The stopping point is a location where the $n^{th}$ mobile object 160 is expected to stop or needs to stop due to a traffic regulation or to reduce the likelihood of a collision. The type of $n^{th}$ mobile object 160 may be for example, a vehicle 105, a pedestrian 160*a*, a bicycle 160*b*, etc.

As described above, using object recognition techniques, the infrastructure computer 155 may be programmed to determine a type of the $n^{th}$ mobile object 160. Based on the type of the $n^{th}$ mobile object 160 and the location, the infrastructure computer 155 may further be programmed to determine the stopping point.

For a vehicle 105, or a bicycle 160*b* travelling on a road 165*a*, 165*b*, the stopping point may be a stop line 165*f* with a stop sign or during a red traffic signal, a crosswalk 165*e*, a location behind another vehicle 105 stopped in the path of the vehicle 105 or bicycle 160*b*, etc.

For a pedestrian 160*a*, or a bicycle 160*b* travelling on a side of a road 165*a*, 165*b*, the stopping point may be prior to entering a crosswalk 165*e* during a period when pedestrian 160*a* crossing is prohibited, or prior to entering the intersection 165*c* in a case that the intersection 165*c* does not have traffic signals 165*d*.

Based on the location of the stopping point, and the location, velocity and acceleration of the mobile object 160, the infrastructure computer 155 may further be programmed to calculate a time T for the $n^{th}$ mobile object 160 to reach the stopping point.

For example, the time T may be calculated according to equation 1:

$$T = \frac{2v_0 + \sqrt{4v_0^2 - 4a_0 d_0}}{2a_0} \quad \text{Eq. 1}$$

where $a_0$ is the current deceleration magnitude, $v_0$ is the current velocity and $d_0$ is the distance between the current location and the stopping point.

In a case that the value under the square root is negative, the $n^{th}$ mobile object 160 will stop before reaching the stopping point. The infrastructure computer 155 may be programmed in this case to set the base priority $P_{base}=0$.

In a case that the value under the square root in equation 1 is positive, the infrastructure computer 155 may be programmed to calculate the base priority $P_{base}$ for the $n^{th}$ mobile object 160 based on the type of the $n^{th}$ mobile object 160, and the time T for the $n^{th}$ mobile object 160 to reach the stopping point.

For example, $P_{base}$ may be calculated according to equation 2:

$$P_{base}=W_{type}e^{-\alpha T} \quad \text{Eq. 2}$$

where $W_{type}$ is a vulnerability rating based on the type of $n^{th}$ mobile object 160, and the factor $\alpha$ is a constant determining a delay rate. Equation 2 provides for weighting the calculation of base priority $P_{base}$ of mobile objects 160 based on their types, and for monotonically decreasing the value of the base priority $P_{base}$ over time.

$W_{type}$ indicates a level of vulnerability of the $n^{th}$ mobile object 160. A pedestrian 160*a*, 160*b* or a bicycle 160*b* may have a level of vulnerability greater than a vehicle 105. The infrastructure computer 155 may be programmed to determine $W_{type}$ based on a type of the mobile object 160. In an example, values of $W_{type}$ may be in a range from 0 to 1 with 0 being the lowest vulnerability and 1 being the highest vulnerability. The infrastructure computer 155 may maintain a table, such as the table 1 below, indicating values of $W_{type}$ for different types of objects.

TABLE 1

| Object Type | $W_{type}$ |
|---|---|
| Vehicle 105 | 0.8 |
| Pedestrian 160a | 1 |
| Bicycle 160b | 1 |

In the example above, $P_{base}$ is monotonically reduced over time. This results in assigning mobile objects 160 a relatively high base priority $P_{base}$ as they enter the region of interest (e.g., are first detected by the infrastructure node 140), and reducing $P_{base}$ thereafter. In this manner, the infrastructure node 140 may prioritize newly arrived mobile objects 160 over mobile objects 160 that arrived earlier and may have been included in previous messages.

The rate of decay of $P_{base}$ for the $n^{th}$ mobile object 160 is established by $\alpha$. The higher $\alpha$, the faster the value of $P_{base}$ decays over time. For example, $\alpha$ may be set to $\alpha$=0.3. This would result in $P_{base}$ decaying from a value of 1 to a value below 0.2 in approximately 5 seconds.

In some cases, calculation of $P_{base}$ may depend on a status of traffic lights along a path of the $n^{th}$ mobile object 160. As an example, based on data received from a traffic light controller 157, the computer 155 may determine that a traffic light at an intersection 165*c* may turn green in a direction of travel of the $n^{th}$ mobile object 160 prior to the $n^{th}$ mobile object 160 entering the intersection 165*c*. In this case, the $n^{th}$ mobile object 160 may not be required to stop at the intersection 165*c* and would have a based priority $P_{base}$ equal to zero.

Upon calculating the base priority for the $n^{th}$ mobile object 160, the process 400 continues in a block 440.

In the block 440, the infrastructure computer 155 is programmed to determine whether the $n^{th}$ mobile object 160 is currently violating or is likely to violate a traffic regulation. For example, based on the location, direction, acceleration of a vehicle 105 or bicycle 160*b*, the infrastructure computer 155 may determine that the vehicle 105 or bicycle 160*b* is travelling the wrong direction in a lane, going to cross the intersection 165*c* against a red light, going to enter a crosswalk 165*e* when pedestrians 160*a* have a right-of-way, etc. For a pedestrian 160*a*, the infrastructure computer 155 may determine that the pedestrian 160*a* is currently crossing the intersection 165*c* outside of the crosswalk 165*e*, is crossing the crosswalk 165*e* when the pedestrian 165*a* does not have right-of-way, etc.

In the case that the infrastructure computer 155 determines that the $n^{th}$ mobile object 160 is violating or is likely to violate a traffic regulation, the process 400 continues in a block 445. In the case that the $n^{th}$ mobile object 160 is operating within traffic regulations, the process 400 continues in a block 450.

In the block 445, the infrastructure computer 155 is programmed to calculate a violation priority $P_{violation}$. As an example, the violation priority $P_{violation}$ may be calculated according to equation 3.

$$P_{violation}=Y_{violation}W_{violation} \quad \text{Eq. 3}$$

$Y_{violation}$ may be, for example, $\alpha$ factor set to 1 in the case that the $n^{th}$ mobile object 160 is violating or likely to violate a traffic regulation and set to zero when the $n^{th}$ mobile object 160 is operating within traffic regulations. $W_{violation}$ may be a vulnerability factor set based on the type of the $n^{th}$ mobile object 160. For example, the infrastructure computer 155 may maintain a table, such as table 2 below indicating $W_{violation}$ for different types of objects.

TABLE 2

| Object Type | $W_{violation}$ |
|---|---|
| Vehicle 105 | 1 |
| Pedestrian 160a | 1 |
| Bicycle 160b | 1 |

Upon calculating the violation priority $P_{violation}$, the process 400 continues in a block 440.

In the block 440, the infrastructure computer 155, determines whether the $n^{th}$ mobile object 160 is a vehicle 105. In the case that the $n^{th}$ mobile object 160 is a vehicle 105, the process 400 continues in a block 445. Otherwise, the process 400 continues in a block 450.

In the block 445, the infrastructure computer 155 is programmed to calculate an abnormality priority $P_{abnormal}$ for the $n^{th}$ mobile object 160. The abnormality priority $P_{abnormal}$ is a numeric value included in the $n^{th}$ mobile object priority calculation due to data indicating an abnormal condition such as activation of an emergency brake system, an auto-lock brake system (ABS) or electronic stability control (ECS) system. The abnormality priority $P_{abnormal}$ may be calculated, for example, according to equation 4.

$$P_{abnormal}=Y_{abnormal}W_{abnormal}e^{-\beta T} \quad \text{Eq. 4}$$

$Y_{abnormal}$ may be an abnormality factor set to 1 in the case that the data for the vehicle 105 indicates an abnormal condition and set to zero otherwise. $W_{abnormal}$ is a vulnerability weighting due to the abnormal condition and may be a predetermined value such as 0.5. $\beta$ is a delay factor and may be a predetermined value such as 0.1.

The process then continues in a block 450. In the block 450, the infrastructure computer 155 is programmed to calculate the priority for the $n^{th}$ mobile object 160. For example, the priority of the $n^{th}$ mobile object 160 may be the sum of the base priority $P_{base}$, the violation priority $P_{violation}$ and the abnormality priority $P_{abnormal}$, as set out in equation 5.

$$P_{object}=P_{base}+P_{violation}+P_{abnormal} \quad \text{Eq. 5}$$

Upon calculating the priority of the $n^{th}$ mobile object 160 $P_{object}$, the process 400 ends.

As used herein, the adverb "substantially" means that a shape, structure, measurement, quantity, time, etc. may deviate from an exact described geometry, distance, measurement, quantity, time, etc., because of imperfections in materials, machining, manufacturing, transmission of data, computational speed, etc.

In general, the computing systems and/or devices described may employ any of a number of computer operating systems, including, but by no means limited to, versions and/or varieties of the Ford Sync® application, AppLink/Smart Device Link middleware, the Microsoft Automotive® operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computers and computing devices generally include computer-executable instructions, where the instructions may be executable by one or more computing devices such as those listed above. Computer executable instructions may be compiled or interpreted from computer programs created using a variety of programming languages and/or technologies, including, without limitation, and either alone or in combination, Java™, C, C++, Matlab, Simulink, Stateflow, Visual Basic, Java Script, Perl, HTML, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer readable medium, etc., and executes these instructions, thereby performing one or more processes, including one or more of the processes described herein. Such instructions and other data may be stored and transmitted using a variety of computer readable media. A file in a computing device is generally a collection of data stored on a computer readable medium, such as a storage medium, a random-access memory, etc.

Memory may include a computer-readable medium (also referred to as a processor-readable medium) that includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random-access memory (DRAM), which typically constitutes a main memory. Such instructions may be transmitted by one or more transmission media, including coaxial cables, copper wire and fiber optics, including the wires that comprise a system bus coupled to a processor of an ECU. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the media, processes, systems, methods, heuristics, etc. described herein, it should be understood that, although the steps of such processes, etc. have been described as occurring according to a certain ordered sequence, such processes may be practiced with the described steps performed in an order other than the order described herein. It further should be understood that certain steps may be performed simultaneously, that other steps may be added, or that certain steps described herein may be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their plain and ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A computer comprising a processor, and a non-transitory memory storing instructions such that the processor is programmed to:

detect a plurality of objects proximate to an infrastructure node; determine respective priorities for each of the objects based on respective characteristics of the objects;

generate a message for radio frequency communications including data representing two or more of the plurality of respective objects, wherein the data is ordered in a sequence within the message according to the respective priorities of the two or more objects wherein data representing the highest priority object precedes data representing the lowest priority object such that the data representing the highest priority object is broadcast first and the data representing the lowest priority object is broadcast last; and broadcast the message via the radio frequency communications.

2. The system of claim 1, wherein the characteristics include a type of object.

3. The system of claim 2, wherein the type of object is one of a group including an on-duty vehicle, a not on-duty vehicle, a bicycle, a scooter and a pedestrian.

4. The system of claim 1, wherein the characteristics include a speed of the object.

5. The system of claim 1, further comprising an intersection, wherein, the characteristics include one of entering or exiting the intersection.

6. The system of claim 1, where the characteristics include a likelihood that an object will violate a traffic regulation.

7. The system of claim 1, wherein the characteristics include a time to reaching a stop line at an intersection.

8. The system of claim 1, wherein the computer is further programmed to:

receive a status of a component of the object; and calculate the priority of the object based on the status of the component.

9. The system of claim 8, wherein the object is a vehicle, and the component is one selected from a group of an emergency brake system, an anti-lock brake system and an electronic stability control system.

10. The system of claim 1, wherein the computer is further programmed to:

receive a status of a traffic light at an intersection, wherein calculating the priority to include the objects in the wireless message is further based on the status of the traffic light.

11. A method comprising:

detecting a plurality of objects proximate to an infrastructure node;

determining respective priorities for each of the objects based on respective characteristics of the objects;

generating a message for radio frequency communications including data representing two or more of the plurality of respective objects, wherein the data is ordered in a sequence within the message according to the respective priorities of the two or more objects wherein data representing the highest priority object precedes data representing the lowest priority object such that the data representing the highest priority object is broadcast first and the data representing the lowest priority object is broadcast last; and broadcasting the message via the radio frequency communications.

12. The method of claim 11, wherein the characteristics include a type of object.

13. The method of claim 12, wherein the type of object is one of a group including an on-duty vehicle, a not on-duty vehicle, a bicycle, a scooter and a pedestrian.

14. The method of claim 11, wherein the characteristics include a speed of the object.

15. The method of claim 11, wherein, the characteristics include one of entering or exiting an intersection.

16. The method of claim 11, where the characteristics include a likelihood that an object will violate a traffic regulation.

17. The method of claim 11, wherein the characteristics include a time to reaching a stop line at an intersection.

18. The method of claim 11, further comprising:

receiving a status of a component of the object; and calculating the priority of the object based on the status of the component.

19. The method of claim 18, wherein the object is a vehicle, and the component is one selected from a group of an emergency brake system, an anti-lock brake system and an electronic stability control system.

20. The method of claim 11, further comprising:

receiving a status of a traffic light at an intersection, wherein calculating the priority to include the objects in the wireless message is further based on the status of the traffic light.

* * * * *